US008967611B2

(12) United States Patent
Joseph et al.

(10) Patent No.: US 8,967,611 B2
(45) Date of Patent: Mar. 3, 2015

(54) INITIATING AN ALIGNMENT CORRECTION CYCLE

(71) Applicant: Hewlett-Packard INDIGO B.V., Amstelveen (NL)

(72) Inventors: Lior Joseph, Nes Ziona (IL); Avihay Menashe, Nes Ziona (IL); Itzik Kent, Nes Ziona (IL)

(73) Assignee: Hewlett-Packard Indigo B.V., Maastricht (NL)

( * ) Notice: Subject to any disclaimer, the term of this patent is extended or adjusted under 35 U.S.C. 154(b) by 88 days.

(21) Appl. No.: 13/906,647

(22) Filed: May 31, 2013

(65) Prior Publication Data

US 2014/0353899 A1 Dec. 4, 2014

(51) Int. Cl.

| | |
|---|---|
| ***B65H 9/20*** | (2006.01) |
| ***B65H 7/20*** | (2006.01) |
| ***B65H 7/14*** | (2006.01) |

(52) U.S. Cl.

CPC .. *B65H 7/20* (2013.01); *B65H 7/14* (2013.01); *B65H 9/20* (2013.01)

USPC ... 270/58.07; 271/227; 271/226; 271/265.02; 399/370; 399/376; 399/389

(58) Field of Classification Search

CPC ..... B65H 7/08; B65H 9/20

USPC ..... 270/58.07, 58.04; 271/226, 227, 271/265.01, 265.02; 399/370, 376, 389

See application file for complete search history.

(56) References Cited

U.S. PATENT DOCUMENTS

| | | | | |
|---|---|---|---|---|
| 6,213,659 | B1 * | 4/2001 | Elgee | 400/633 |
| 7,880,871 | B2 * | 2/2011 | Kazama et al. | 356/139.04 |
| 7,912,384 | B2 * | 3/2011 | Dan | 399/16 |
| 8,083,220 | B2 * | 12/2011 | Kato et al. | 270/58.1 |
| 8,228,544 | B2 | 7/2012 | Mori | |
| 8,260,162 | B2 | 9/2012 | Nishikata | |
| 8,456,652 | B2 * | 6/2013 | Unno | 358/1.12 |
| 8,494,431 | B2 * | 7/2013 | deJong et al. | 399/395 |
| 8,670,703 | B2 * | 3/2014 | Mihara | 399/389 |
| 2002/0020963 | A1 * | 2/2002 | Steinkogler et al. | 271/315 |
| 2006/0186594 | A1 * | 8/2006 | Mitsuya et al. | 271/262 |
| 2007/0091331 | A1 | 4/2007 | Ohashi | |
| 2008/0095549 | A1 * | 4/2008 | Yoshizawa | 399/45 |
| 2010/0078868 | A1 * | 4/2010 | Kato et al. | 270/58.17 |
| 2011/0068529 | A1 * | 3/2011 | Taguchi et al. | 270/58.11 |
| 2011/0097125 | A1 * | 4/2011 | Dejong et al. | 399/394 |
| 2011/0292411 | A1 | 12/2011 | Cortes et al. | |

OTHER PUBLICATIONS

Enhanced Finishing Options and Streamlined User Interface Make Xerox's Production Printers More Productive; Xerox Corporation; May 13, 2008; http://www.dpsmagazine.com/Content/ContentCT.asp?P=791&cmpyNm=Xerox%20Corporation.

* cited by examiner

*Primary Examiner* — Patrick Mackey

(57) ABSTRACT

In an embodiment, a processor-readable medium stores code representing instructions that when executed by a processor cause the processor to receive sheet length data for two paper sheets of a same standard dimension passing consecutively through a printing device. The processor calculates a length difference between the two paper sheets, and when the length difference exceeds a two-sheet threshold, it initiates an alignment correction cycle in a paper finishing device.

17 Claims, 6 Drawing Sheets

KEY
LPS = Length of Prior Sheet
LNS = Length of Next Sheet
SC = Sheet Count
TST = Two-Sheet Threshold
SCT = Sheet Count Threshold
AVGSCT = Average length of most recent SCT # of sheets
TT = Trend Threshold

INITIATING AN ALIGNMENT CORRECTION CYCLE

BACKGROUND

Print production processes implement both sheetfed and web offset lithography devices such as printing presses that print, respectively, onto individual sheets and large rolls of paper. In either case, these print production processes typically employ one or more post-print finishing devices that perform additional finishing operations on printed material after printing has been completed. A finishing operation generally includes any post-printing process, such as slitting, trimming, die-cutting, folding, coating, embossing, and binding. Finishing operations can be performed by one or more finishing devices that are in-line or near-line with the printing device.

With in-line printing processes, finishing devices are connected directly to a single printing device so that printed material passes directly from the printer to the one or more in-line finishing devices without being removed from the process and taken to other devices. With near-line printing processes, finishing devices are not connected directly to a particular printing device, so printed material (e.g., stacks of printed sheet paper) needs to be demounted from the printing device and remounted on the one or more near-line finishing devices. While the need to transfer printed material to near-line finishing devices seems disadvantageous, it has the advantage of allowing near-line finishing devices to process printed material from more than one printing device. In general, advantages and disadvantages between the use of in-line or near-line finishing devices depend on factors such as printing speeds, finishing device processing speeds, printer downtime, and so on.

One challenge that persists with regard to sheetfed print production processes is achieving an accurate alignment of the sheet paper between the printing device and the finishing device. Paper sheets are cut to standard sizes, such as "A", "B", and "C" series paper sizes, and various standards specify tolerances for the different sized sheets. For example, the tolerance for a "B2" sheet size is ±2-3 mm under the international paper size standard, ISO. When changing between different printing modes (e.g., simplex and duplex), the printing device and finishing device can align the sheet of paper to opposite edges. Is such cases, the paper tolerance can create alignment inaccuracies with in-line finishing processes.

BRIEF DESCRIPTION OF THE DRAWINGS

The present embodiments will now be described, by way of example, with reference to the accompanying drawings, in which.

Throughout the drawings, identical reference numbers designate similar, but not necessarily identical, elements.

DETAILED DESCRIPTION

Overview

Figure 1:
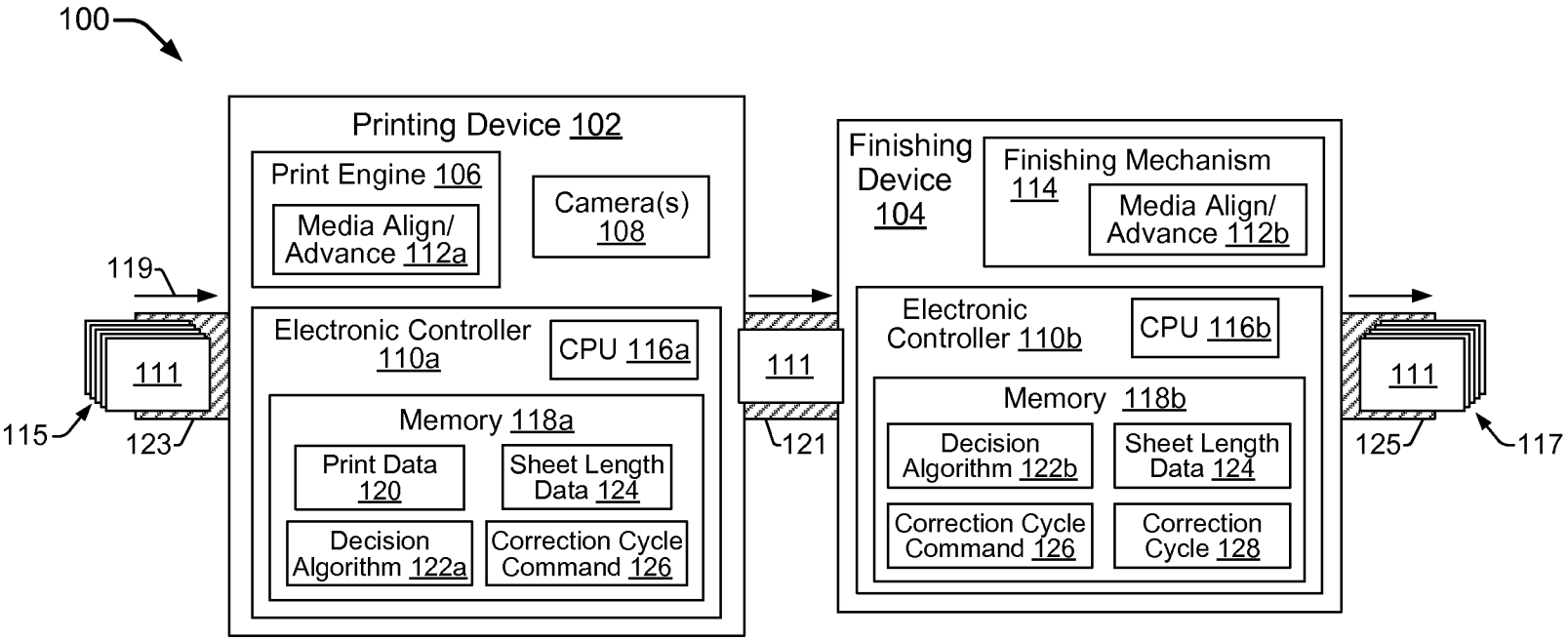
FIG. 1 shows an in-line printing system suitable for implementing a decision algorithm that determines when to initiate a paper sheet alignment correction cycle, according to an example implementation.

As alluded to above, the manner in which paper sheets are aligned within printing and finishing devices can change for different printing modes (i.e., simplex and duplex modes). Due to tolerances in standard cut paper sizes, this can create misalignments in the finishing processes that can result in misplaced and/or deficient finishing effects. For example, finishing effects such as paper slits, trims, die-cuts, folds, and so on, that are added to the paper sheets by the finishing device, can be aligned incorrectly with respect to printed matter (e.g., text, graphics, etc.) that has been previously applied to the paper sheets by the printing device.

In the simplex printing mode, the printing device prints on one side of the paper sheet, and the sheet is aligned in both the printing device and the finishing device to the leading edge of the sheet (i.e., the same edge of the sheet). Because the finishing device and printing device align the sheet to the same edge in simplex mode, the paper tolerance overhang, or residue, at the trailing edge of the sheet does not create an alignment issue between the printed output and the finishing effect.

However, in duplex printing mode, the printing device prints on both sides of the paper sheet. Duplex printing entails flipping the paper sheet over within the printing device. Nevertheless, the paper sheet is still aligned to the leading edge of the page within the printer, and both sides of the sheet are printed according to the leading edge alignment. In the finishing device, however, because the paper sheet has been flipped over within the printing device, the sheet aligns to the trailing edge instead of the leading edge. This occurs primarily when the printing and finishing devices are configured in an in-line printing process where the paper sheets move directly from the printing device to the connected finishing device. It can also occur in a near-line printing process where the printed sheets are manually transferred from the printer to the finishing device (e.g., on a pallet). When the printing device and finishing device align the paper sheets to opposite edges (i.e., leading edge vs. trailing edge), the finishing effect applied by the finishing device can be misaligned with respect to the printed output on the paper sheet by an amount that corresponds to the tolerance overhang, or residue, that exists at the trailing edge of the sheet.

Embodiments of the present disclosure help to remedy the misalignment of sheetfed pages between printing and finishing devices, generally through a decision algorithm that determines when to execute a fine-tune, alignment correction cycle within the finishing device. A printing device employs cameras during printing to measure the lengths of paper sheets that are of the same standard dimension. In one implementation, the printing device forwards camera-measured sheet length data, on-the-fly, to an in-line finishing device that executes an algorithm to determine if an alignment correction cycle should be run. Sheet length data is gathered in this manner and stored for each paper sheet as it passes through the printing device. As sheet length data is received from the printing device, the algorithm performs a difference calculation to calculate the difference between the last two sheets. When the difference in length between two consecutive sheets exceeds a two-sheet threshold, the algorithm initiates an alignment correction cycle on the finishing device. The alignment correction cycle aligns the second sheet so that the finishing effect is applied at the correct location on the sheet. When the difference in length between two consecutive sheets does not exceed the two-sheet threshold, the algorithm determines if the total number of sheets (i.e., a sheet count (SC)) exceeds a sheet-count threshold (SCT). If the sheet-count threshold has been exceeded, the algorithm determines if the average length of the previous SCT number of sheets exceeds a trend threshold. When the average length of the previous SCT number of sheets exceeds the trend threshold, the algorithm initiates the alignment correction cycle on the finishing device.

In an example implementation, a processor-readable medium stores code representing instructions that when executed by a processor cause the processor to receive sheet length data for two paper sheets of a same standard dimension passing consecutively through a printing device. The code further causes the processor to calculate a length difference between the two paper sheets, and when the length difference exceeds a two-sheet threshold, initiate an alignment correction cycle in a paper finishing device.

In another example implementation, a processor-readable medium stores code representing instructions that when executed by a processor cause the processor to receive a matching list that includes measured sheet lengths matched to specific paper sheets from a printed media stack. The processor runs a first and second paper sheet from the printed media stack through a finishing device and compares measured sheet lengths from the list for the first and second paper sheets. The processor initiates a correction cycle on the second paper sheet when a difference in measured sheet lengths between the first and second paper sheets exceeds a two-sheet threshold.

In another example implementation, a processor-readable medium stores code representing instructions that when executed by a processor cause the processor to receive and store a prior sheet length, receive and store a next sheet length, increment a sheet count (SC) for each sheet length received, and calculate a length difference between the prior and next sheet lengths. When the length difference exceeds a two-sheet threshold as determined by the processor, the processor causes the execution of an alignment correction cycle. When the length difference does not exceed the two-sheet threshold, the processor determines if the SC exceeds a sheet count threshold (SCT). When the SC exceeds the SCT, the processor calculates an average sheet length of the most recent sheets numbering up to the SOT. When the average sheet length exceeds a trend threshold, the processor causes the execution of the alignment correction cycle.

ILLUSTRATIVE EMBODIMENTS

FIG. 1 illustrates an example of an in-line printing system 100 suitable for implementing a decision algorithm that determines when to initiate a paper sheet alignment correction cycle, as disclosed herein. The in-line printing system 100 includes a printing device 102 physically coupled to a post-print finishing device 104. Printing device 102 generally comprises a print-on-demand printing device that implements variable data printing using one of several different printing technologies, such as electrophotographic printing (e.g. liquid electrophotography (LEP), dry-toner electrophotography) or inkjet printing. Thus, printing device 102 may include, for example, a digital LEP press, a digital inkjet press, a large-format digital laser printer, and so on. Throughout this disclosure, a printing device 102 may be variously referred to as a printing device, a printer, a printing press, a digital press, or a press.

As shown in FIG. 1, printing device 102 includes a print engine 106, one or more cameras 108, and an electronic controller 110*a*. Print engine 106 comprises components of a printing mechanism that translate signals from electronic controller 110*a* into printed images. In one example, print engine 106 comprises components of an electrophotographic printer that operate to apply toner or liquid ink to a print medium (e.g., sheet paper) 111 through an electrostatic imaging process. Thus, an electrophotographic print engine 106 generally includes an electrostatic charge mechanism (e.g., a charge roller), a photo imaging member (e.g., photo imaging plate (PIP), photoconductor drum), a laser assembly, dry-toner or liquid ink supplies, a developer roller, an image transfer element (e.g., a transfer blanket, drum, belt), and a fuser assembly.

In an example electrophotographic print process, a charge mechanism applies an electrostatic charge to a photo imaging member, such as a photoconductor drum. As the photoconductor drum rotates, a laser assembly writes a latent image onto the drum with a laser that discharges electrostatic charge from appropriate portions of the drum. A toner supply guides toner to a developer roller, and as the developer roller and photoconductor drum rotate, toner is developed to the latent image on the photoconductor drum. Different color components of an image can also be developed onto the photoconductor drum in this manner. Each color can be developed onto the photoconductor drum and transferred one color at a time to an image transfer element (e.g., a transfer blanket). The full image is then transferred or "offset" from the blanket to the paper sheet 111 (or other print media 111) and fused in a fuser assembly before the sheet 111 exits the print engine 106. The movement and alignment of paper sheets 111 through the print engine 106 is managed by various media alignment and advancement mechanisms 112*a*. Media alignment and advancement mechanisms 112*a* can include, for example, guide rollers, alignment bars, moving platforms, and so on.

In another example, print engine 106 comprises components of an inkjet printer that operate to apply liquid ink to a print medium 111 (e.g., paper sheet 111) through an ink jetting process. An inkjet-based print engine 106 generally includes multiple printheads integrated onto one or more printbars, several fluid supplies that supply liquid bonding agents and different colored inks to the printheads, a printhead service station to maintain the printheads, and a dryer that provides warm air to dry the paper sheet 111 (or other print media 111) after application of the liquid ink. During operation, as the media alignment and advancement mechanism 112*a* transports paper sheets 111 past the printbar, printhead nozzles are activated by signals from controller 110*a* to eject droplets of ink onto the sheets 111. Printhead nozzles are typically arranged in one or more columns or arrays so that properly sequenced ejection of ink from the nozzles causes characters, symbols, and/or other graphics or images to be printed on the print media 111 as it moves past the printbar.

Referring still to FIG. 1, finishing device 104 includes a finishing mechanism 114 and an electronic controller 110*b*. Finishing mechanism 114 can include various mechanisms operable to perform one or more post-printing processes on a printed paper sheet 111. Such processes include, for example, slitting, trimming, die-cutting, folding, coating, embossing, and binding. Thus, a finishing mechanism 114 may include knives, scissors, die forms, fold bars, liquid depositors, binders, and so on. Finishing mechanism 114 also includes media alignment and advancement mechanisms 112*b* to control the movement and alignment of paper sheets 111 through the finishing device 104. Similar to the media alignment and advancement mechanisms 112*a* on printing device 102, the media alignment and advancement mechanisms 112*b* on finishing device 104 can include mechanisms such as guide rollers, alignment bars, moving platforms, and so on.

Also shown in FIG. 1 are a media supply stack 115 and media output stack 117. During printing, paper sheets 111 move from the media supply stack 115 to the media output stack 117 in the direction of arrows 119 through printing device 102 and finishing device 104, which are directly coupled to one another through physical connection 121. Connection 121 comprises a media pathway between printing device 102 and finishing device 104, as well as a hard-wired connection that enables data to be transferred between the printing device 102 and finishing device 104. The paper sheets 111 on media supply stack 115 comprise cut-sheet paper of a particular standard size, such as B2 size. In a given implementation, the standard size of the paper sheets 111 in media supply stack 115 is the same standard size. More specifically, for a particular print job, all of the paper sheets 111 in media supply stack 115 are the same standard size. However, between different print jobs, the standard size of the paper sheets 111 in media supply stack 115 may change. For example, in a first print job the paper sheets 111 in media supply stack 115 may be size B2, while in a next print job, the paper sheets 111 in media supply stack 115 may be size B3. Paper sheets 111 from media supply stack 115 are typically input to printing device 102 by a cut-sheet feeder device 123. Media output stack 117 comprises finished paper sheets 111 that have been printed and have had one or more finishing effects applied, such as cutting, folding, binding, and so on. Finished paper sheets are typically output to a cut-sheet stacker device 125.

Referring again to printing device 102 and finishing device 104, the electronic controllers 110*a* and 110*b* generally include, respectively, processors (CPU) 116*a* and 116*b*, and memories 118*a* and 118*b*. In addition to processor 116*a* and memory 118*a*, controller 110*a* may also include firmware and other electronics for communicating with and controlling print engine 106, cameras 108, and media alignment and advancement mechanisms 112*a*. Memory 118 (118*a*, 118*b*) can include both volatile (i.e., RAM) and nonvolatile (e.g., ROM, hard disk, floppy disk, CD-ROM, etc.) memory components comprising non-transitory computer/processor-readable media that provide for the storage of computer/processor-readable coded instructions, data structures, program modules, JDF, and other data. For example, electronic controller 110*a* receives print data 120 from a host system, such as a computer, and stores the data 120 in memory 118*a*. Data 120 represents, for example, a document or image file to be printed. As such, data 120 forms a print job for printing device 102 that includes one or more print job commands and/or command parameters. Using data 120, electronic controller 110*a* controls print engine 106 to form characters, symbols, and/or other graphics or images on paper sheets 111.

In one implementation, electronic controller 110*a* includes a correction cycle decision algorithm 122*a* and sheet length data 124 stored in memory 118*a*. Correction cycle decision algorithm 122*a* comprises instructions executable on processor 116*a* to control components of printing device 102 for generating sheet length data 124 while paper sheets 111 pass through print engine 106. More specifically, decision algorithm 122*a* executes on processor 116*a* to control cameras 108 to capture images of each paper sheet 111 while the print engine 106 prints on the sheet 111. Decision algorithm 122*a* uses the images to measure, or calculate, the length of each sheet 111. While the paper sheets 111 being imaged and measured are of the same standard size (e.g., size B2), each standard sheet size has a tolerance within which the length of the sheet can vary. For example, the tolerance for a B2 sheet size is ±2-3 mm. Decision algorithm 122*a* accurately measures the actual length of each paper sheet 111 so that differences in sheet lengths can be determined, as discussed here below.

In one implementation, the measured sheet lengths are stored as sheet length data 124 on printing device 102 and used on-the-fly (i.e., as each sheet 111 is measured) by decision algorithm 122*a* to determine when to send a correction cycle initiation command 126 to the finishing device 104. Thus, as a printed sheet 111 transfers directly from the printing device 102 to the finishing device 104, the corresponding sheet length data 124 is used in real time to determine whether a correction cycle 128 is appropriate for that same sheet. In this implementation, the decision to initiate (i.e., execute) a correction cycle 128 on the finishing device 104 is made by the decision algorithm 122*a* executing on the printing device 102. In other implementations, however, the decision to initiate a correction cycle 128 on the finishing device 104 is made by the decision algorithm 122*b* executing on the finishing device 104. The specific steps performed by algorithms 122*a* and 122*b* to determine when to initiate a correction cycle are discussed in detail herein below.

As just noted, in another implementation, decision algorithm 122*b* executing on finishing device 104 determines when to initiate a correction cycle 128. Accordingly, memory 118*b* on electronic controller 110*b* includes decision algorithm 122*b* executable on processor 116*b*. In this implementation, decision algorithm 122*a* on printing device 102 executes to capture images of each paper sheet 111 with cameras 108, and sends measured sheet length data 124 on-the-fly (i.e., as each sheet 111 is measured) to the finishing device 104. Decision algorithm 122*b* executes on finishing device 104 to receive the sheet length data 124, and uses the data 124 to determine in real-time when to send a correction cycle command 126, initiating a correction cycle 128. Thus, in one implementation, decision algorithm 122*a* on printing device 102 generates and analyzes sheet length data 124, and determines when to initiate a correction cycle 128. In another implementation, decision algorithm 122*a* on printing device 102 generates the sheet length data 124 and sends it to the finishing device 104, where decision algorithm 122*b* analyzes the data 124 and determines when to initiate a correction cycle 128.

A correction cycle 128 is executable on processor 116*b* to control a fine-tune setup of the media alignment mechanisms 112*b* on finishing device 104. For example, a correction cycle 128 can include adjusting the positions of media alignment bars within the finishing device 104 to ensure that the finishing mechanism 114 properly positions a finishing effect (e.g., a paper slit) on the paper sheet 111. A correction cycle 128 can also adjust the positions of the finishing mechanisms 114 to ensure that the finishing effect is properly positioned on the paper sheet 111. For example, a correction cycle 128 can adjust the positions of slitters, or knives, with respect to the paper sheet 111 such that the finishing effect (i.e., the paper cut) is properly located on the sheet 111. A correction cycle 128 can also implement a combination of adjustments to both the alignment mechanisms 112*b* and the finishing mechanisms 114.

The specific steps performed by decision algorithms 122*a* and 122*b* to determine when to initiate a correction cycle 128, are the same for both algorithms. That is, algorithms 122*a* and 122*b* are the same with respect to determining when to initiate a correction cycle 128. Algorithms 122*a* and 122*b* differ in that 122*a* gathers paper sheet images and generates the sheet length data 124. In this respect, therefore, decision algorithms 122*a* and 122*b* can be collectively referred to as decision algorithm 122.

Decision algorithm 122 selectively determines when to initiate an alignment correction cycle 128 on finishing device 104 based on two different types of calculations. A first calculation finds the difference in length between two consecutively printed sheets 111, and the algorithm 122 compares the difference to a "two-sheet threshold" to determine whether to initiate a correction cycle 128. A second calculation finds an average length of a number of most recently printed sheets 111, and the algorithm 122 compares the average to a "trend threshold" to determine whether to initiate a correction cycle 128.

Figure 2:
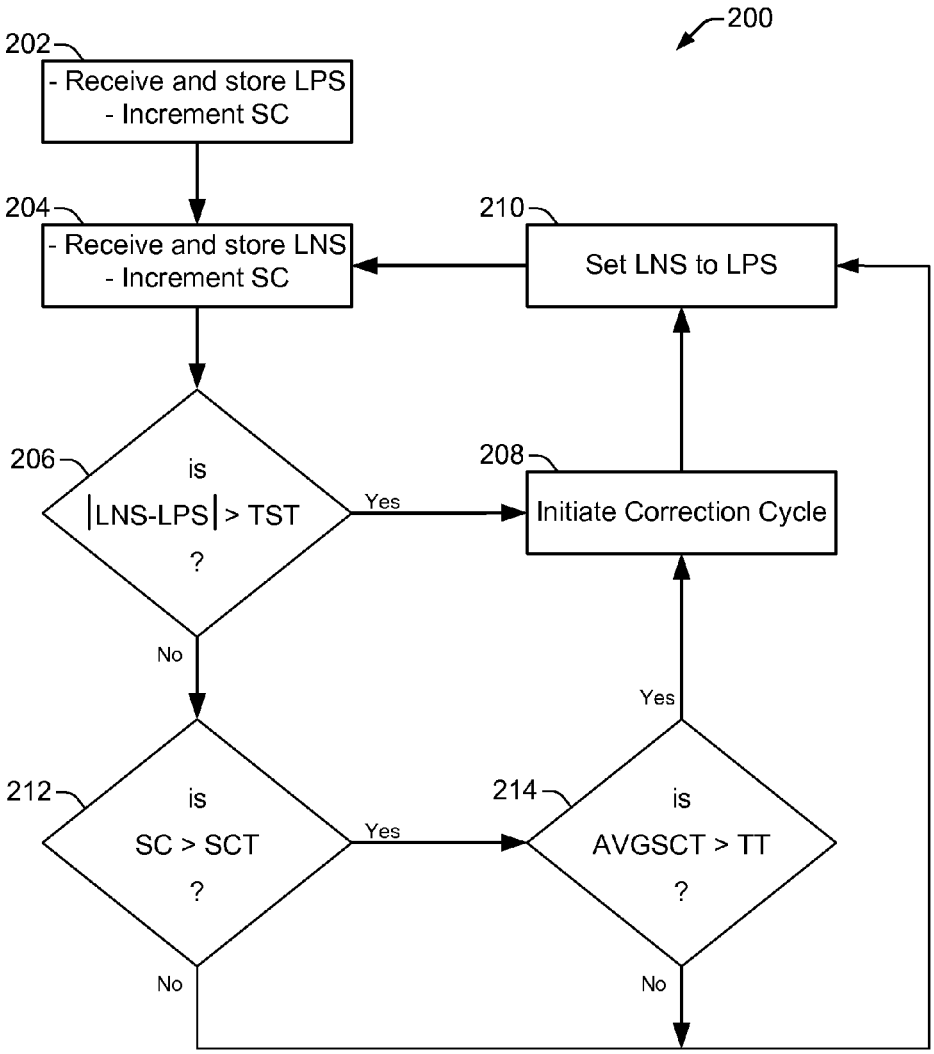
FIG. 2 shows a flow chart illustrating how calculations are implemented by a decision algorithm, according to an example implementation.

FIG. 2 shows a flow chart 200 illustrating the steps of decision algorithm 122 in greater detail, and how these calculations are implemented by the algorithm 122. At block 202 of flow chart 200, the length of a prior sheet (LPS) is received and stored. Therefore, a prior sheet (which initially is the first sheet through the printing system 100) has been imaged by cameras 108 and measured, and the length of that prior sheet is received by the algorithm 122. A sheet count (SC) is also incremented at block 202 to keep track of how many sheets 111 have been printed. At block 204, the length of a next sheet (LNS) is received and stored. The SC is incremented again at block 204 to keep track of how many sheets 111 have been printed.

At decision block 206, the absolute difference between the LNS and LPS is calculated and compared to a two-sheet threshold (TST). Thus, the length of two consecutively printed sheets is being compared. If the difference is greater than the TST, the algorithm 122 initiates a correction cycle 128 on the finishing device 104. The algorithm 122 then makes the LNS into the LPS at block 210 (i.e., it sets LNS=LPS), and returns to block 204 to receive and store a new LNS, and to increment SC. If, however, the difference at decision block 206 is not greater than the TST, the algorithm 122 determines if the sheet count, SC, exceeds a sheet count threshold (SCT), as shown at decision block 212. If the SCT has not been exceeded, the algorithm 122 again makes the LNS into the LPS at block 210 (i.e., it sets LNS=LPS), and returns to block 204 to receive and store a new LNS, and to increment SC.

If the SCT has been exceeded, however, the algorithm 122 calculates the average length of the most recent SCT number of sheets (i.e., the AVGSCT) and determines if the AVGSCT is greater than a trend threshold (TT), as shown at decision block 214. Thus, the slope of the lengths of the most recent SCT number of sheets is compared to a trend threshold to see if the sheet lengths are trending up or down above a certain threshold amount. If the AVGSCT is not greater than the TT, then the algorithm 122 again makes the LNS into the LPS at block 210 (i.e., it sets LNS=LPS), and returns to block 204 to receive and store a new LNS, and to increment SC. If the AVGSCT is greater than the TT, however, the algorithm 122 initiates a correction cycle 128 on the finishing device 104. The algorithm 122 then makes the LNS into the LPS at block 210 (i.e., it sets LNS=LPS), and returns to block 204 to receive and store a new LNS, and to increment SC. It is worth noting that in other implementations, at block 214, the algorithm can calculate the average length of a different number of sheets other that the most recent SCT number of sheets.

Figure 3:
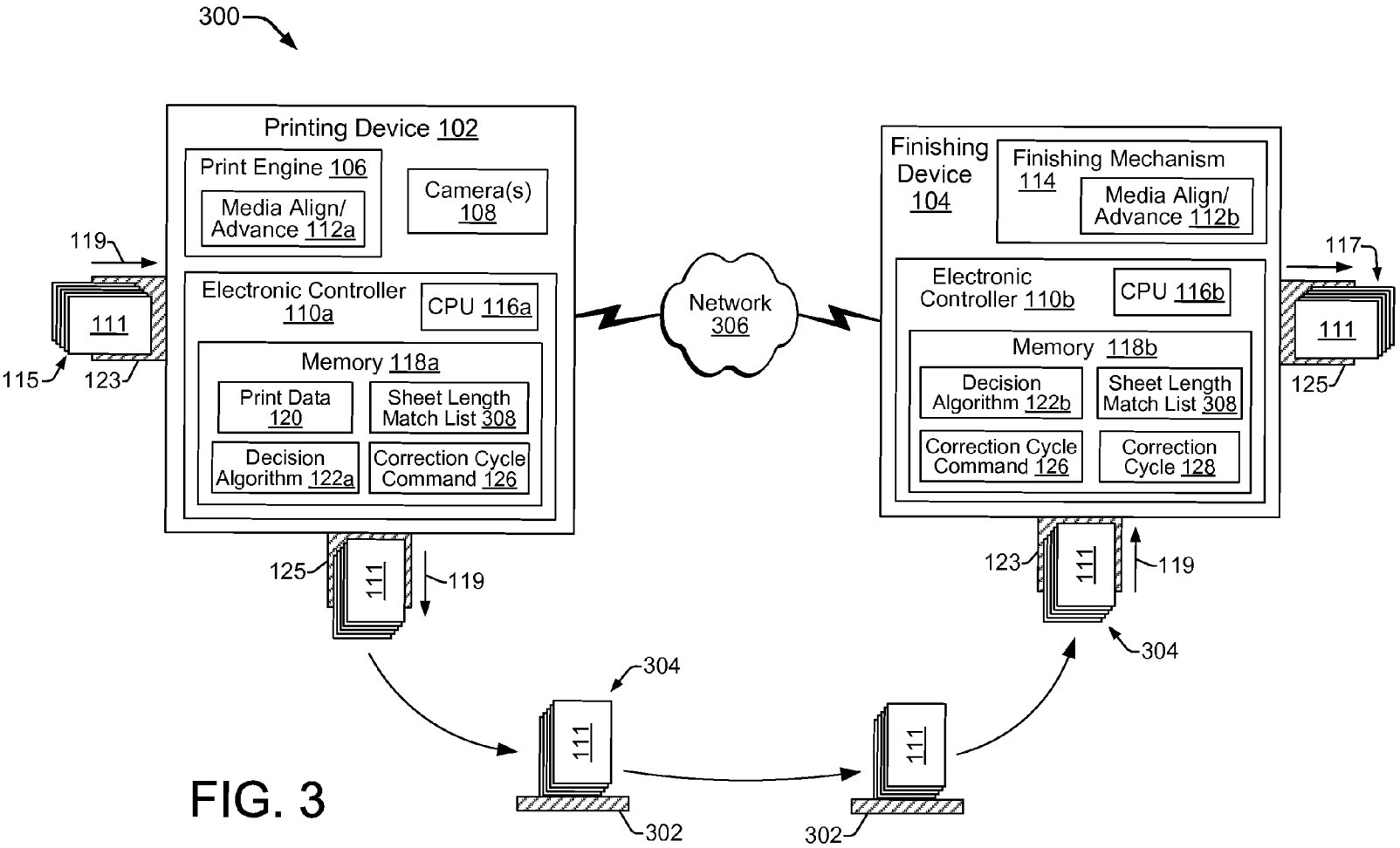
FIG. 3 shows a near-line printing system suitable for implementing a decision algorithm that determines when to initiate a paper sheet alignment correction cycle, according to an example implementation.

FIG. 3 illustrates an example of a near-line printing system 300 suitable for implementing a decision algorithm that determines when to initiate a paper sheet alignment correction cycle, as disclosed herein. The near-line printing system 300 includes a printing device 102 that is not physically coupled to the post-print finishing device 104. In the near-line system 300, both the printing device 102 and finishing device 104 are stand-alone machines that typically have an input sheet feeder device 123 and an output sheet stacker device 125. Therefore, printed paper sheets 111 do not travel directly between the printing device 102 and finishing device 104. Instead, printed paper sheets 111 output from the printing device 102 are transported manually (e.g., on a pallet 302) in media stacks 304 to the finishing device 104.

In addition, because there is not a direct physical connection between the printing and finishing devices, there is usually not a hard-wire connection between the devices that would enable direct, on-the-fly, data transfers as in the in-line system 100 discussed above. However, as shown in FIG. 3, the near-line printing system 300 can couple the printing device 102 and finishing device 104 through a network 306. Network 306 represents any of a variety of conventional network topologies and types employing any of a variety of conventional network protocols (including public and/or proprietary protocols). Network 306 may include or be a part of, for example, a corporate network, the cloud or the Web/Internet, as well as one or more local area networks (LANs) and/or wide area networks (WANs) and combinations thereof. While near-line printing and finishing devices are typically not hard-wired, in some instances network 306 can also include a cable or other suitable local communication link.

While algorithms 122 function in generally the same manner as discussed above regarding FIGS. 1 and 2, the near-line system 300 is unable to transfer paper sheets 111 with corresponding sheet length data directly from the printing device 102 to the finishing device 104, on-the-fly, as in the in-line system 100. However, this issue is remedied by a sheet length matching list 308 that includes sheet length data measured for each sheet 111. The sheet length matching list 308 matches each sheet length with a specific sheet (e.g., by sheet number) within printed media stacks 304. Thus, while a pallet 302 with a printed media stack 304 is transferred from the printing device 102 to the finishing device 104, the sheet length matching list 308 is transmitted from the printing device 102 over the network 306 to the finishing device 104. When the printed media stack 304 is run through the finishing device 104, the decision algorithm 122*b* uses the matching list 308 to match measured sheet lengths to the appropriate sheets within the printed media stack 304, and determines when to initiate a correction cycle 128 in a manner as discussed above with regard to FIG. 2.

Figure 4:
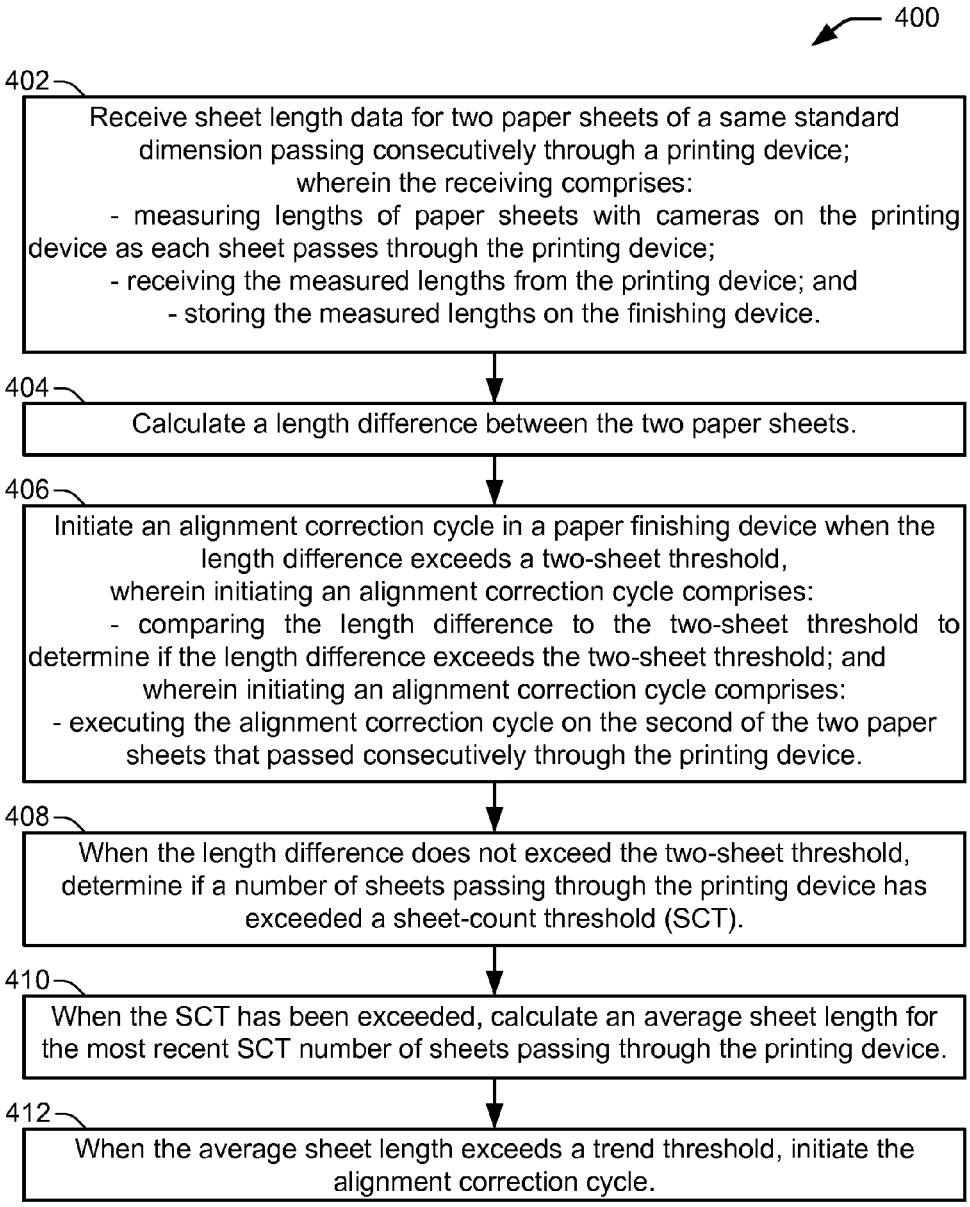
FIGS. 4, 5, and 6, show flowcharts of example methods related to implementing a decision algorithm that determines when to initiate a paper sheet alignment correction cycle in a finishing device, according to different example implementations.
Figure 5:
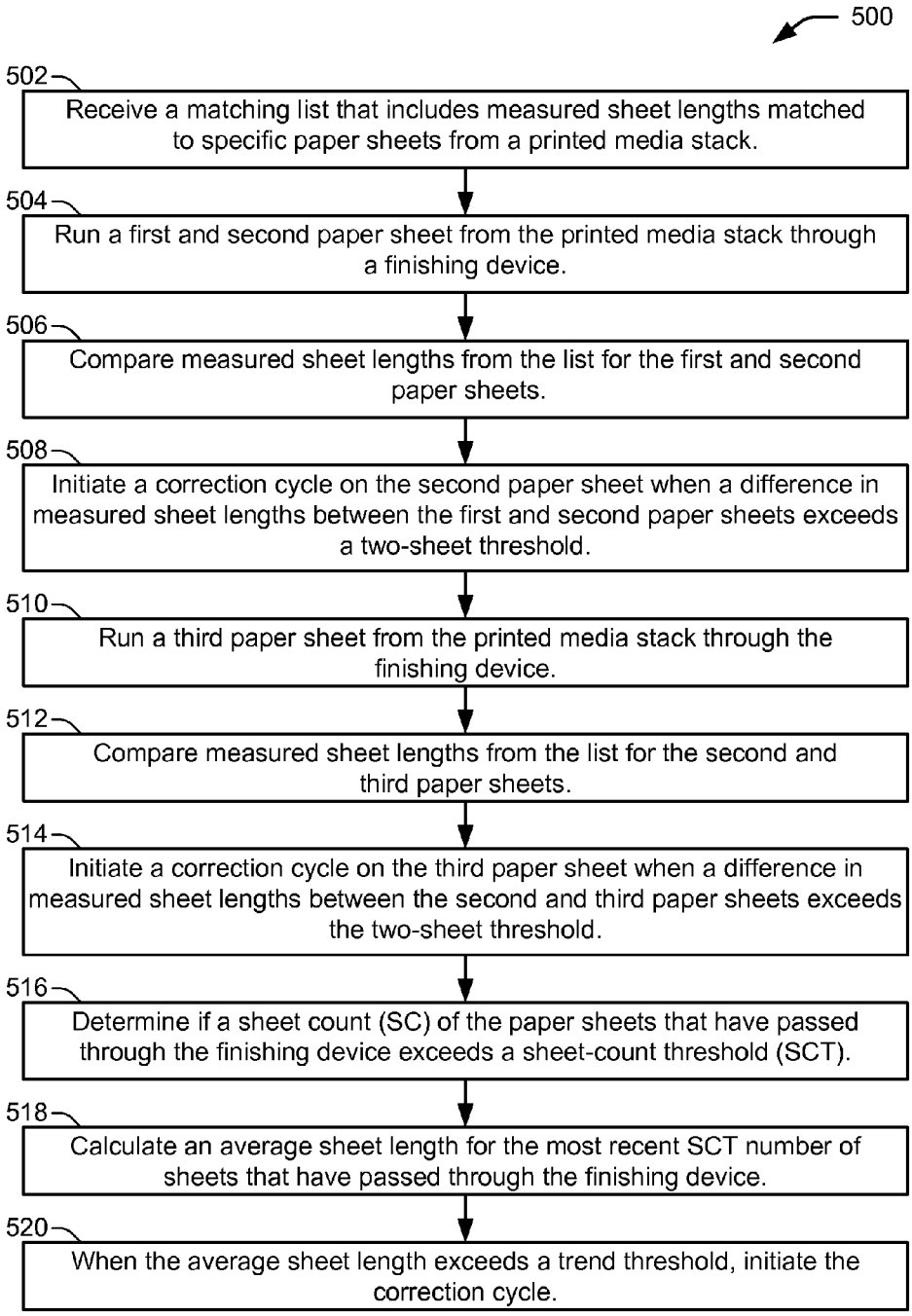
Figure 6:
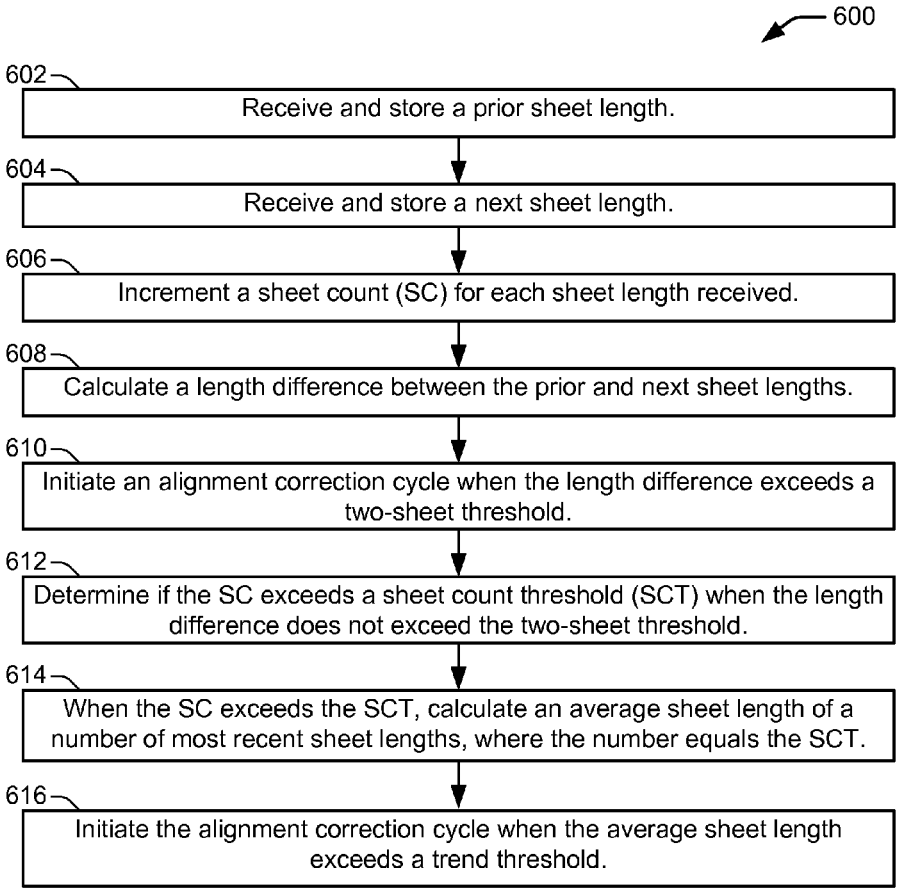

FIGS. 4, 5, and 6, show flowcharts of example methods 400, 500, and 600, related to implementing a decision algorithm that determines when to initiate a paper sheet alignment correction cycle in a finishing device. Methods 400, 500, and 600, are associated with the example implementations discussed above with regard to FIGS. 1-3, and details of the steps shown in methods 400, 500, and 600, can be found in the related discussion of such implementations. The steps of methods 400, 500, and 600, may be embodied as programming instructions stored on a non-transitory computer/processor-readable medium, such as memory 118*a* and 118*b* of FIGS. 1 and 3. In different examples, the implementation of the steps of methods 400, 500, and 600, is achieved by the reading and execution of such programming instructions by a processor, such as processor 116*a* and 116*b* of FIGS. 1 and 3. Methods 400, 500, and 600, may include more than one implementation, and different implementations of methods 400, 500, and 600, may not employ every step presented in the flowcharts. Therefore, while steps of methods 400, 500, and 600, are presented in a particular order within the flowcharts, the order of their presentation is not intended to be a limitation as to the order in which the steps may actually be implemented, or as to whether all of the steps may be implemented. For example, one implementation of method 400 might be achieved through the performance of a number of initial steps, without performing one or more subsequent steps, while another implementation of method 400 might be achieved through the performance of all of the steps.

Referring to FIG. 4, method begins at block 402, where the first step shown is to receive sheet length data for two paper sheets of a same standard dimension passing consecutively through a printing device. In different implementations, receiving the sheet length data can include measuring lengths of paper sheets with cameras on the printing device as each sheet passes through the printing device, receiving the measured lengths from the printing device, and storing the measured lengths on the finishing device. At block 404, the method 400 calculates a length difference between the two paper sheets, and at block 406, the method 400 initiates an alignment correction cycle in a paper finishing device when the length difference exceeds a two-sheet threshold. In different implementations, initiating the alignment correction cycle includes comparing the length difference to the two-sheet threshold to determine if the length difference exceeds the two-sheet threshold, and executing the alignment correction cycle on the second of the two paper sheets that passed consecutively through the printing device. The method 400 continues at block 408 when the length difference does not exceed the two-sheet threshold, with determining if a number of sheets passing through the printing device has exceeded a sheet-count threshold (SCT). At block 410, when the SCT has been exceeded, the method calculates an average sheet length for the most recent SCT number of sheets passing through the printing device, and at block 412, when the average sheet length exceeds a trend threshold, the method initiates the alignment correction cycle. In different implementations, an average sheet length can be calculated for a number of sheets other than the most recent SCT number of sheets. Thus, the average sheet length can be calculated for a greater or lesser number of sheets that the SCT number. Furthermore, specific values used for both the sheet count threshold (SCT) and trend threshold can be adjusted in different implementations.

Referring to FIG. 5, method 500 begins at block 502 with receiving a matching list that includes measured sheet lengths matched to specific paper sheets from a printed media stack. At block 504, a first and second paper sheet are run through a finishing device from the printed media stack, and the measured sheet lengths from the list for the first and second paper sheets are compared, as shown at block 506. A correction cycle is initiated on the second paper sheet when a difference in measured sheet lengths between the first and second paper sheets exceeds a two-sheet threshold, as shown at block 508. At block 510 of method 500, a third paper sheet from the printed media stack is run through the finishing device. The measured sheet lengths from the list for the second and third paper sheets are compared, and a correction cycle is initiated on the third paper sheet when a difference in measured sheet lengths between the second and third paper sheets exceeds the two-sheet threshold, as shown at blocks 512 and 514, respectively. At block 516, the method 500 determines if a sheet count (SC) of the paper sheets that have passed through the finishing device exceeds a sheet-count threshold (SCT), and an average sheet length is calculated for the most recent SCT number of sheets that have passed through the finishing device, as shown at block 518. In different implementations, an average sheet length can be calculated for a number of sheets other than the most recent SCT number of sheets. Thus, the average sheet length can be calculated for a greater or lesser number of sheets that the SCT number. When the average sheet length exceeds a trend threshold, a correction cycle is initiated in the finishing device, as shown at block 520. In different implementations, the specific value used for both the sheet count threshold (SCT) and trend threshold can be adjusted.

Referring to FIG. 6, method 600 begins at block 602 with receive and storing a prior sheet length. At block 604, a next sheet length is received and stored. For each sheet length received, a sheet count (SC) is incremented, as shown at block 606. At block 608, a length difference between the prior and next sheet lengths is calculated, and an alignment correction cycle is initiated when the length difference exceeds a two-sheet threshold, as shown at block 610. At block 612, when the length difference does not exceed the two-sheet threshold, the method 600 determines if the SC exceeds a sheet count threshold (SCT), and when the SC exceeds the SCT, the method 600 calculates an average sheet length of a number of the most recent sheet lengths, where the number equals the SCT, as shown at block 614. In different implementations, the method 600 can calculate an average sheet length using a different number of most recent sheet lengths, as an alternative to using the SCT number. An alignment correction cycle is initiated when the average sheet length exceeds a trend threshold as shown at block 616. In different implementations, the specific value used for both the sheet count threshold (SCT) and trend threshold can be adjusted.

What is claimed is:

1. A processor-readable medium storing code representing instructions that when executed by a processor cause the processor to:

receive sheet length data for two paper sheets of a same standard dimension passing consecutively through a printing device;

calculate a length difference between the two paper sheets; and when the length difference exceeds a two-sheet threshold, initiate an alignment correction cycle in a paper finishing device.

2. A processor-readable medium as in claim 1, wherein the instructions further cause the processor to:

when the length difference does not exceed the two-sheet threshold, determine if a number of sheets passing through the printing device has exceeded a sheet-count threshold (SCT);

when the SCT has been exceeded, calculate an average sheet length for a number of most recent sheets passing through the printing device; and when the average sheet length exceeds a trend threshold, initiate the alignment correction cycle.

3. A processor-readable medium as in claim 1, wherein calculating an average sheet length for a number of most recent sheets comprises calculating the average sheet length using SCT as the number of most recent sheets.

4. A processor-readable medium as in claim 1, wherein receiving sheet length data comprises:

measuring lengths of paper sheets with cameras on the printing device as each sheet passes through the printing device;

receiving the measured lengths from the printing device; and storing the measured lengths on the finishing device.

5. A processor-readable medium as in claim 1, wherein initiating an alignment correction cycle in a paper finishing device comprises comparing the length difference to the two-sheet threshold to determine if the length difference exceeds the two-sheet threshold.

6. A processor-readable medium as in claim 1, wherein initiating an alignment correction cycle in a paper finishing device comprises executing the alignment correction cycle on the second of the two paper sheets that passed consecutively through the printing device.

7. A processor-readable medium storing code representing instructions that when executed by a processor cause the processor to:

receive a matching list that includes measured sheet lengths matched to specific paper sheets from a printed media stack;

run a first and second paper sheet from the printed media stack through a finishing device;

compare measured sheet lengths from the list for the first and second paper sheets; and initiate a correction cycle in a finishing device on the second paper sheet when a difference in measured sheet lengths between the first and second paper sheets exceeds a two-sheet threshold.

8. A processor-readable medium as in claim 7, wherein the instructions further cause the processor to:

run a third paper sheet from the printed media stack through the finishing device;

compare measured sheet lengths from the list for the second and third paper sheets; and initiate a correction cycle on the third paper sheet when a difference in measured sheet lengths between the second and third paper sheets exceeds the two-sheet threshold.

9. A processor-readable medium as in claim 7, wherein the instructions further cause the processor to:

determine if a sheet count (SC) of the paper sheets that have passed through the finishing device exceeds a sheet-count threshold (SCT);

calculate an average sheet length for the most recent sheets within the SCT that have passed through the finishing device; and when the average sheet length exceeds a trend threshold, initiate the correction cycle.

10. A processor-readable medium storing code representing instructions that when executed by a processor cause the processor to:

receive and store a prior sheet length;

receive and store a next sheet length;

increment a sheet count (SC) for each sheet length received;

calculate a length difference between the prior and next sheet lengths;

initiate an alignment correction cycle when the length difference exceeds a two-sheet threshold;

determine if the SC exceeds a sheet count threshold (SCT) when the length difference does not exceed the two-sheet threshold;

when the SC exceeds the SCT, calculate an average sheet length of a number of most recent sheet lengths, where the number equals the SC; and initiate the alignment correction cycle when the average sheet length exceeds a trend threshold.

11. A processor-readable medium as in claim 10, wherein receiving and storing a sheet length comprises:

acquiring images of paper sheets with a camera on a printing device as each paper sheet passes through the printing device;

measuring lengths of the paper sheets based on the images;

receiving the measured lengths from the printing device; and storing the measured lengths on a finishing device.

12. A processor-readable medium as in claim 11, wherein receiving the measured lengths from the printing device comprises transferring the measured lengths from the printing device directly to an in-line finishing device via a wired connection.

13. A processor-readable medium as in claim 11, wherein receiving the measured lengths from the printing device comprises transferring the measured lengths from the printing device indirectly to a near-line finishing device via a network connection.

14. A processor-readable medium as in claim 10, wherein receiving and storing a sheet length comprises:

acquiring images of paper sheets with a camera on a printing device as each paper sheet passes through the printing device;

measuring lengths of the paper sheets based on the images; and storing the measured lengths on the printing device.

15. A processor-readable medium as in claim 10, wherein the receiving, storing, incrementing, calculating a length difference, initiating an alignment correction cycle, determining, and calculating an average sheet length, are implemented on a paper finishing device.

16. A processor-readable medium as in claim 10, wherein:

the receiving, storing, incrementing, calculating a length difference, determining, and calculating an average sheet length, are implemented on a printing device; and the initiating an alignment correction cycle is implemented on a paper finishing device.

17. A processor-readable medium as in claim 16, wherein the initiating an alignment correction cycle comprises sending an instruction from the printing device to the paper finishing device causing the paper finishing device to execute the alignment correction cycle.

* * * * *